US009976100B2

(12) United States Patent
Kodama

(10) Patent No.: US 9,976,100 B2
(45) Date of Patent: May 22, 2018

(54) LUBRICANT COMPOSITION

(71) Applicant: FUJIFILM Corporation, Tokyo (JP)

(72) Inventor: Kunihiko Kodama, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days. days.

(21) Appl. No.: 15/248,045

(22) Filed: Aug. 26, 2016

(65) Prior Publication Data

US 2016/0362624 A1 Dec. 15, 2016

Related U.S. Application Data

(63) Continuation of application No. PCT/JP2015/052923, filed on Feb. 3, 2015.

(30) Foreign Application Priority Data

Feb. 27, 2014 (JP) ..... 2014-037528

(51) Int. Cl.

| | |
|---|---|
| ***C10M 105/42*** | (2006.01) |
| ***C10M 145/22*** | (2006.01) |
| ***C10M 169/04*** | (2006.01) |
| ***C10M 107/32*** | (2006.01) |
| ***C10M 129/78*** | (2006.01) |

(52) U.S. Cl.

CPC ..... *C10M 105/42* (2013.01); *C10M 107/32* (2013.01); *C10M 129/78* (2013.01); *C10M 145/22* (2013.01); *C10M 169/04* (2013.01); *C10M 2203/024* (2013.01); *C10M 2203/1006* (2013.01); *C10M 2205/003* (2013.01); *C10M 2207/0406* (2013.01); *C10M 2207/2805* (2013.01); *C10M 2207/30* (2013.01); *C10M 2207/301* (2013.01); *C10M 2209/102* (2013.01); *C10M 2209/1023* (2013.01); *C10N 2230/06* (2013.01); *C10N 2230/08* (2013.01)

(58) Field of Classification Search

CPC ..... C10M 105/42; C10M 169/04; C10M 129/78; C10M 107/32; C10M 145/22; C10M 2203/1006; C10M 2209/1023; C10M 2203/024; C10M 2207/30; C10M 2207/301; C10M 2209/102; C10M 2207/2805; C10N 2230/06; C10N 2230/08

See application file for complete search history.

(56) References Cited

U.S. PATENT DOCUMENTS

| | | | | |
|---|---|---|---|---|
| 3,859,318 A * | 1/1975 | Lesuer | ..... | C08G 65/2615 508/223 |
| 4,036,771 A * | 7/1977 | Denis | ..... | C08G 65/332 508/494 |
| 5,219,479 A | 6/1993 | Mathiesen et al. | | |
| 9,255,058 B2 | 2/2016 | Kawata et al. | | |
| 2012/0184474 A1 | 7/2012 | Kawata et al. | | |

FOREIGN PATENT DOCUMENTS

| | | | | |
|---|---|---|---|---|
| GB | 778132 A * | 7/1957 | ..... | C07C 67/08 |
| JP | 56106997 A * | 8/1981 | ..... | B23H 7/04 |
| JP | 06108390 A * | 4/1994 | | |
| JP | 2002-097482 A | 4/2002 | | |
| JP | 2005-213377 A | 8/2005 | | |
| JP | 2005-232434 A | 9/2005 | | |
| JP | 2005-232470 A | 9/2005 | | |
| WO | 98/10040 A1 | 3/1998 | | |
| WO | 98/10043 A1 | 3/1998 | | |

OTHER PUBLICATIONS

International Preliminary Report on Patentability dated Sep. 9, 2016 from the International Bureau in counterpart International Application No. PCT/JP2015/052923.

International Search Report for PCT/JP2015/052923 dated Apr. 28, 2015.

Written Opinion for PCT/JP2015/052923 dated Apr. 28, 2015.

Extended European Search Report dated Jan. 2, 2017, from the European Patent Office in counterpart European Application No. 15755290.2.

* cited by examiner

*Primary Examiner* — Taiwo Oladapo

(74) *Attorney, Agent, or Firm* — Sughrue Mion, PLLC

(57) ABSTRACT

An object of the present invention is to provide a lubricant composition having excellent lubrication properties in rigorous conditions such as a high temperature and/or a high pressure. The present invention relates to lubricant composition containing a condensate A which is obtained by condensing at least: an alkylene oxide adduct a1 of trihydric or more polyhydric alcohol formed by adding alkylene oxide to at least one hydroxyl group of the trihydric or more polyhydric alcohol; a divalent or more polyvalent carboxylic acid a2 or a precursor of the divalent or more polyvalent carboxylic acid a2; and at least one of a monovalent carboxylic acid a3, a precursor of the monovalent carboxylic acid a3, or monohydric alcohol a4.

13 Claims, No Drawings

LUBRICANT COMPOSITION

CROSS-REFERENCE TO RELATED APPLICATIONS

This application is a Continuation of PCT International Application No. PCT/JP2015/052923, filed on Feb. 3, 2015, which claims priority under 35 U.S.C. Section 119(a) to Japanese Patent Application No. 2014-037528 filed on Feb. 27, 2014. Each of the above applications is hereby expressly incorporated by reference, in its entirety, into the present application.

BACKGROUND OF THE INVENTION

1. Field of the Invention

The present invention relates to a lubricant composition. More specifically, the present invention relates to a lubricant composition which contains a condensate having a specific structure, and has excellent lubrication properties in rigorous conditions such as a high temperature and/or a high pressure.

2. Description of the Related Art

In general, a lubricant contains base oil and various additives. Examples of the base oil include mineral oil obtained from crude oil, ester-based oil which is chemically synthesized, fluorine-based oil, poly a olefin-based oil, and the like. Among them, the ester-based oil is preferably used in a jet plane, automobile engine oil, grease, and the like from the viewpoint of a low pour point, a high viscosity index, a high ignition point, excellent lubrication properties, biodegradability, and the like.

Various esters such as monoester obtained from a reaction between an aliphatic monocarboxylic acid and monohydric alcohol; diester obtained from a reaction between an aliphatic dibasic acid and monohydric alcohol; ester obtained from a reaction between polyhydric alcohol and an aliphatic carboxylic acid; and composite ester obtained from a reaction between polyol, a polybasic acid, and an aliphatic monocarboxylic acid, have been disclosed as the ester-based oil (JP2002-097482A, JP2005-154726A, JP2005-232434A, JP2005-213377A, JP2005-232470A, JP2001-501989A, JP2001-500549A, JP2001-507334A, and JP2011-89106A).

SUMMARY OF THE INVENTION

However, even in ester lubricating oil, lubrication properties are not sufficient in rigorous situation such as a high pressure and/or a high temperature, and thus, a compound which has excellent lubrication properties, in particular, low friction, and is useful as base oil of a lubricant or an additive has been required.

An object of the present invention is to provide a lubricant composition having excellent lubrication properties in rigorous conditions such as a high temperature and/or a high pressure.

As a result of various studies of the present inventors for attaining the object described above, it has been found that a lubricant composition containing a condensate which is obtained by condensing specific alcohol and a specific carboxylic acid exhibits excellent lubrication properties in rigorous conditions such as a high temperature and/or a high pressure, and is able to be preferably used as lubricating oil or lubricating an oil additive having low friction.

That is, the object described above is attained by the present invention having configurations described below.

[1] A lubricant composition containing a condensate A which is obtained by condensing at least: an alkylene oxide adduct a1 of trihydric or more polyhydric alcohol formed by adding alkylene oxide to at least one hydroxyl group of the trihydric or more polyhydric alcohol; a divalent or more polyvalent carboxylic acid a2 or a precursor of the divalent or more polyvalent carboxylic acid a2; and at least one of a monovalent carboxylic acid a3, a precursor of the monovalent carboxylic acid a3, or monohydric alcohol a4.

[2] In the lubricant composition according to [1], it is preferable that the alkylene oxide adduct a1 of the trihydric or more polyhydric alcohol is formed by adding alkylene oxide to at least one hydroxyl group of at least one selected from trimethylol propane, trimethylol ethane, ditrimethylol propane, glycerol, pentaerythritol, and dipentaerythritol.

[3] In the lubricant composition according to [1] or [2], it is preferable that the alkylene oxide adduct a1 of the trihydric or more polyhydric alcohol includes six or more alkylene oxy repeating units in the molecules on average.

[4] In the lubricant composition according to any one of [1] to [3], it is preferable that the alkylene oxide adduct a1 of the trihydric or more polyhydric alcohol is formed by adding alkylene oxides each independently to all hydroxyl groups of the trihydric or more polyhydric alcohol.

[5] In the lubricant composition according to any one of [1] to [4], it is preferable that the number of carbon atoms of the monovalent carboxylic acid a3 is greater than or equal to 8.

[6] In the lubricant composition according to any one of [1] to [5], it is preferable that the monovalent carboxylic acid a3 has a branch alkyl group.

[7] In the lubricant composition according to any one of [1] to [6], it is preferable that the monohydric alcohol a4 has a branch alkyl group.

[8] In the lubricant composition according to any one of [1] to [7], it is preferable that the monohydric alcohol a4 has an alkylene oxy structure.

[9] In the lubricant composition according to any one of [1] to [8], it is preferable that the number of carbon atoms of the divalent or more polyvalent carboxylic acid a2 or the precursor of the divalent or more polyvalent carboxylic acid a2 is greater than or equal to 36.

[10] In the lubricant composition according to any one of [1] to [9], it is preferable that the condensate A is a pure substance or a mixture having a structure in which a structure derived from the alkylene oxide adduct a1 of the trihydric or more polyhydric alcohol is bonded to a structure derived from the monohydric alcohol a4 through a structure derived from the divalent or more polyvalent carboxylic acid a2 or the precursor of the divalent or more polyvalent carboxylic acid a2, and/or a structure in which a structure derived from the divalent or more polyvalent carboxylic acid a2 or the precursor of the divalent or more polyvalent carboxylic acid a2 is bonded to a structure derived from the monovalent carboxylic acid a3 or the precursor of the monovalent carboxylic acid a3 through a structure derived from the alkylene oxide adduct a1 of the trihydric or more polyhydric alcohol.

[11] In the lubricant composition according to any one of [1] to [10], it is preferable that the condensate A is a polymer.

[12] In the lubricant composition according to any one of [1] to [11], it is preferable that the condensate A is contained in the amount of 0.01 mass % to 20 mass % with respect to the total lubricant composition.

[13] In the lubricant composition according to any one of [1] to [12], it is preferable that a ratio of the condensate A is 0.1 mass % to 20 mass %, and a ratio of a medium is 70 mass % to 99.9 mass %, and a ratio of a component other than the condensate A and the medium is 0 mass % to 29.9 mass %, with respect to the total lubricant composition.

[14] In the lubricant composition according to [13], it is preferable that the medium is at least one selected from mineral oil, polyolefin oil, ester oil, and ether oil.

[15] In the lubricant composition according to [13] or [14], it is preferable that the component other than the condensate A and the medium is a compound having at least one of zinc, molybdenum, sulfur, or phosphorus as a constituent element.

According to the present invention, it is possible to provide a lubricant composition having excellent lubrication properties in rigorous conditions such as a high temperature and/or a high pressure.

DESCRIPTION OF THE PREFERRED EMBODIMENTS

Hereinafter, a lubricant composition of the present invention will be described in detail.

The following description of configuration requirements are based on representative embodiments of the present invention, but the present invention is not limited to the embodiments. Furthermore, herein, a numerical range denoted by using "to" indicates a range including the numerical values before and after "to" as the lower limit value and the upper limit value.

Herein, a condensate indicates a reaction product which is obtained by a condensation reaction.

Herein, a reaction mixture indicates a composition which is obtained by a reaction.

Herein, a reaction mixture of condensation indicates a composition which is obtained by a condensation reaction. Here, the reaction mixture of condensation may include various condensates (including condensate A) such as polyester, ester oligomer, and low molecular ester which are obtained by a condensation reaction of a raw material described below, unreacted alcohol raw material, and a mixture of a carboxylic acid raw material.

[Lubricant Composition]

A lubricant composition of the present invention contains a condensate A which is obtained by condensing at least an alkylene oxide adduct a1 of trihydric or more polyhydric alcohol formed by adding alkylene oxide to at least one hydroxyl group of the trihydric or more polyhydric alcohol, a divalent or more polyvalent carboxylic acid a2 or a precursor of the divalent or more polyvalent carboxylic acid a2, and at least one of a monovalent carboxylic acid a3, a precursor of the monovalent carboxylic acid a3, or monohydric alcohol a4.

In order to have such a configuration, the lubricant composition of the present invention has excellent lubrication properties in rigorous conditions such as a high temperature and/or a high pressure.

<Condensate A>

(Structure of Condensate A)

In the structure of the condensate A, each of components a1, a2, a3, and a4 to be used in a condensation reaction for obtaining the condensate A, and other components will be described.

(a1) Alkylene Oxide Adduct of Trihydric or More Polyhydric Alcohol

The alkylene oxide adduct a1 (hereinafter, also referred to as an (a1) component) of the trihydric or more polyhydric alcohol formed by adding alkylene oxide to at least one hydroxyl group of the trihydric or more polyhydric alcohol which is a component to be used in the condensation reaction for obtaining the condensate A will be described.

The trihydric or more polyhydric alcohol is a compound having three or more alcoholic hydroxyl groups and/or phenolic hydroxyl groups in the molecules, and a compound having three or more alcoholic hydroxyl groups is preferable, and a compound having 3 to 6 alcoholic hydroxyl groups is more preferable, as the trihydric or more polyhydric alcohol.

A preferred trihydric or more polyhydric alcohol is alcohol denoted by General Formula (a1-1) described below.

General Formula (a1-1)

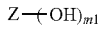

In General Formula (a1-1), Z represents an m1-valent linking group, and m1 represents an integer of greater than or equal to 3.

The alcohol denoted by General Formula (a1-1) is m1-hydric alcohol.

In General Formula (a1-1), Z represents an m1-valent linking group, and in other words, Z indicates a mother nucleus of polyhydric alcohol which is formed by removing m1 hydroxyl groups from m1-hydric alcohol.

Z is an m1-valent linking group having at least one trivalent or more linking group. The trivalent or more linking group is not particularly limited, and examples of the trivalent or more linking group are able to preferably include a trivalent linking group having a tertiary carbon atom, a quaternary carbon atom, and the like.

The following structure is preferable as the trivalent linking group having a tertiary carbon atom, and in the following structure, $R^c$ represents a hydrogen atom or a substituent group.

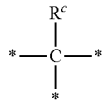

The quaternary carbon atom has the following structure.

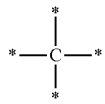

An alkylene group, an arylene group, and a structure in which a plurality of alkylene groups or arylene groups are bonded to each other through a single bond, a divalent linking group (preferably, —O—, —C(=)O—, —OC(=)O—, —S—, —$SO_2$—, —C(=O)—, and —C(=O)$NR^b$— ($R^b$:H, an alkyl group, and an aryl group)), or a trivalent or more linking group are preferable as Z, and Z is an m1-valent linking group having at least one trivalent or more linking group.

Other substituent groups may be included on the divalent linking group.

Preferred Z is a residue which is obtained by removing a hydroxyl group from a preferred example of trihydric or more polyhydric alcohol described below.

m1 is an integer of greater than or equal to 3, is preferably an integer of 3 to 6, and is more preferably an integer of 3 or 4.

Specifically, trihydric alcohol such as glycerin, 1,2,3-butane triol, 1,2,4-butane triol, 1,2,3-pentane triol, 1,2,4-pentane triol, 2-methyl-1,2,3-propane triol, 2-methyl-2,3,4-butane triol, 2-ethyl-1,2,3-butane triol, 2,3,4-pentane triol, 3-methyl pentane-1,3,5-triol, 2,4-dimethyl-2,3,4-pentane triol, 2,3,4-hexane triol, 4-propyl-3,4,5-heptane triol, 1,3,5-cyclohexane triol, pentamethyl glycerin, trimethylol ethane, and trimethylol propane, tetrahydric alcohol such as 1,2,3,4-butane tetraol, pentaerythritol, diglycerin, sorbitan, ribose, arabinose, xylose, lyxose, ditrimethylol ethane, and ditrimethylol propane, pentahydric alcohol such as arabitol, xylitol, glucose, fructose, galactose, mannose, allose, gulose, idose, and talose, hexahydric alcohol such as dipentaerythritol, sorbitol, galactitol, mannitol, allitol, iditol, talitol, inositol, and quercitol, and octahydric alcohol such as tripentaerythritol are preferable as the trihydric or more polyhydric alcohol.

Among them, the trimethylol ethane, the trimethylol propane, the glycerol, the pentaerythritol, the ditrimethylol ethane, the ditrimethylol propane, and the dipentaerythritol or the tripentaerythritol are particularly preferable.

The alkylene oxide adduct a1 of the trihydric or more polyhydric alcohol is a compound formed by adding alkylene oxide to at least one hydroxyl group of the trihydric or more polyhydric alcohol. The alkylene oxide to be added is preferably ethylene oxide, propylene oxide, butylene oxide, and a combination of a plurality thereof, and is more preferably ethylene oxide and propylene oxide.

It is preferable that the alkylene oxide adduct a1 of the trihydric or more polyhydric alcohol is formed by adding alkylene oxides each independently to all hydroxyl groups of the trihydric or more polyhydric alcohol.

The number of added alkylene oxides is preferably 3 to 200, and is more preferably 6 to 100, in the alkylene oxide adduct a1 of the trihydric or more polyhydric alcohol on average. It is more preferable that the alkylene oxide adduct a1 of the trihydric or more polyhydric alcohol has six or more alkylene oxy repeating units in the molecules on average from the viewpoint of lubrication properties in rigorous conditions such as a high temperature and/or a high pressure.

The number of added alkylene oxides is more preferably 1 time to 20 times, is even more preferably 2 times to 10 times, and is particularly preferably 3 times to 7 times the number of hydroxyl groups of the trihydric or more polyhydric alcohol on average.

It is preferable that the alkylene oxide adduct a1 of the trihydric or more polyhydric alcohol is a compound denoted by General Formula (a1-2) described below.

General Formula (a1-2)

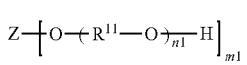

In General Formula (a1-2), Z represents an m1-valent linking group, m1 represents an integer of greater than or equal to 3, $R^{11}$ represents an alkylene group, and n1 represents an integer of 1 to 100.

Z and m1 in General Formula (a1-2) are identical to Z and m1 in General Formula (a1-1). Preferred Z is a residue which is obtained by removing a hydroxyl group from a preferred example of trihydric or more polyhydric alcohol described below.

$R^{11}$ is an alkylene group, is preferably an ethylene group, a propylene group, and a butylene group, and is more preferably an ethylene group and a propylene group. A plurality of $R^{11}$'s may be identical to each other or different from each other.

n1 is 1 to 100, is preferably 1 to 20, is more preferably 2 to 10, and is particularly preferably 3 to 7. A plurality of n1's may be identical to each other or different from each other.

(a2) Divalent or more Polyvalent Carboxylic Acid or Precursor of Polyvalent Carboxylic Acid The divalent or more polyvalent carboxylic acid a2 or the precursor of the divalent or more polyvalent carboxylic acid a2 (hereinafter, also referred to as an (a2) component) which is a component to be used in the condensation reaction for obtaining the condensate A will be described.

The divalent or more polyvalent carboxylic acid a2 or the precursor of the divalent or more polyvalent carboxylic acid a2 is a compound having two or more carboxyl groups or carboxylic acid precursor structures, is preferably a compound having 2 to 4 carboxyl groups or carboxylic acid precursor structures, is more preferably a compound having 2 or 3 carboxyl groups or carboxylic acid precursor structures, and is even more preferably a compound having 2 carboxyl groups or carboxylic acid precursor structures. Here, the precursor indicates a group which is able to form an ester bond by reacting with the alkylene oxide adduct a1 of the trihydric or more polyhydric alcohol or the alcohol of the monohydric alcohol a4, and carboxylic acid halide, carboxylic acid ester (preferably, methyl ester and ethyl ester), carboxylic anhydride (preferably, succinic anhydride), and mixed anhydride of a carboxylic acid and other acids (preferably, a sulfonic acid such as a methane sulfonic acid and a toluene sulfonic acid, and a substituted carboxylic acid such as a trifluoroacetic acid) are preferable as the precursor. Hereinafter, in the detailed description of the divalent or more polyvalent carboxylic acid a2, the precursor is also included.

The carboxyl groups in the molecules of the divalent or more polyvalent carboxylic acid a2 may be linked by chain or cyclic divalent or more aliphatic hydrocarbon or aromatic hydrocarbon. One or more carbon atoms which are not adjacent to each other in carbon atoms of an aliphatic hydrocarbon linking group or an aromatic hydrocarbon linking group may be substituted with an oxygen atom.

The number of carbon atoms of the divalent or more polyvalent carboxylic acid a2 is preferably greater than or equal to 4, is preferably greater than or equal to 10, is more preferably greater than or equal to 18, is even more preferably greater than or equal to 22, is particularly preferably greater than or equal to 26, and is more particularly preferably greater than or equal to 36. In addition, the number of carbon atoms of the divalent or more polyvalent carboxylic acid a2 is preferably less than or equal to 70, is more preferably less than or equal to 66, and is even more preferably less than or equal to 59. Furthermore, in the present invention, the number of carbon atoms of the divalent or more polyvalent carboxylic acid a2 indicates the number of carbon atoms in which the number of carbon atoms configuring the carboxyl group is also included. Thus, by setting the number of carbon atoms of the divalent or more polyvalent carboxylic acid a2 to be in the range described above, it is possible to further increase lubrication properties, and lubrication properties in rigorous conditions such as a high temperature and/or a high pressure.

Examples of the divalent or more polyvalent carboxylic acid a2 which is able to be used in the present invention are able to include a terephthalic acid, a phthalic acid, a malonic acid, a succinic acid, a glutaric acid, an adipic acid, a suberic acid, an azelaic acid, a sebacic acid, a dodecanedioic acid, a trimellitic acid, a dimer acid (a dimer of an unsaturated carboxylic acid having 18 carbon atoms), and a hydrogenated body of a dimer acid, trimer acid (a trimer of an unsaturated carboxylic acid having 18 carbon atoms), a dimer of an unsaturated carboxylic acid having 22 carbon atoms (for example, an erucic acid dimer), and the like. Among them, it is preferable to use the dimer acid, the hydrogenated body of the dimer acid, the trimer acid, and the dimer of the unsaturated carboxylic acid having 22 carbon atoms from the viewpoint of lubrication properties in rigorous conditions such as a high temperature and/or a high pressure, and solubility with respect to base oil, and it is more preferable to use the dimer acid, the hydrogenated body of the dimer acid, and the dimer of the unsaturated carboxylic acid having 22 carbon atoms.

Here, the dimer acid indicates an aliphatic or alicyclic dicarboxylic acid (a trimer, a monomer, and the like other than major dimers are usually contained in the amount of several mol %) which is generated by dimerizing an unsaturated fatty acid (in general, an unsaturated fatty acid having 18 carbon atoms) according to polymerization, Diels-Alder reaction, or the like, and among them, a trimer acid containing a trimer as a main component is defined as the trimer acid.

In specific examples of the dimer acid or the trimer acid, examples of the dimer acid include TSUNODYMES (Registered Trademark) 205, 216, 228, and 395 manufactured by TSUNO CO., LTD., and examples of the trimer acid include TSUNODYME 345 and the like. In addition, products manufactured by BASF SE and UNIQEMA LIMITED may be used.

Hereinafter, specific examples of the divalent or more polyvalent carboxylic acid a2 and the precursor of the divalent or more polyvalent carboxylic acid a2 which are able to be used in the present invention will be described, but the present invention is not limited thereto.

CA-1

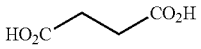

CA-2

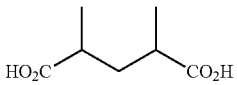

CA-3

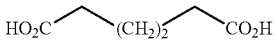

CA-4

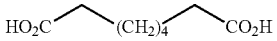

CA-5

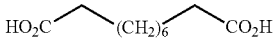

CA-6

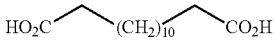

CA-7

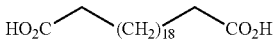

CA-8

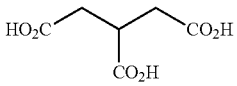

CA-9

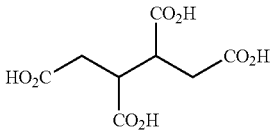

-continued

CA-10

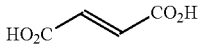

CA-11

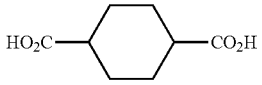

CA-12

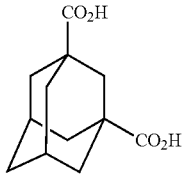

CA-13

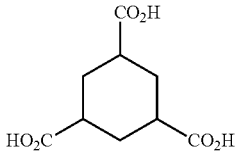

CA-14

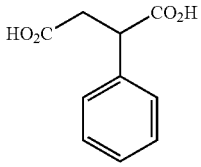

CA-15

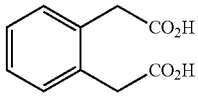

CA-16

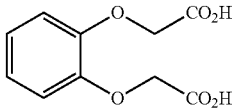

CA-17

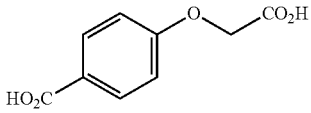

CA-18

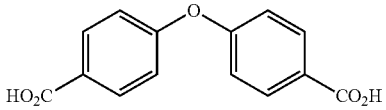

CA-19

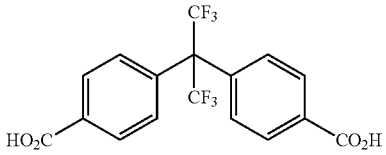

CA-20

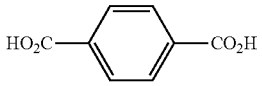

CA-21

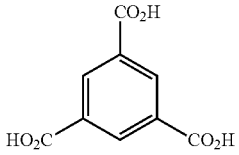

-continued

CA-22

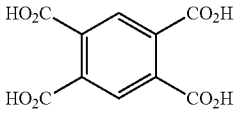

CA-23

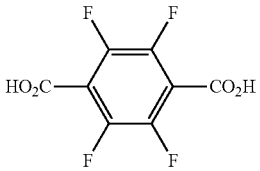

CA-24

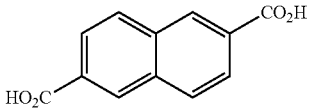

CA-25

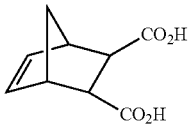

CA-26

$C_{34}H_{62}(COOH)_2$

Dimer Acid

CA-27

$C_{51}H_{93}(COOH)_3$

Trimer Acid $C_{42}H_{82}(COOH)_2$

Dimer of Unsaturated Carboxylic Acid Having 22 Carbon Atoms

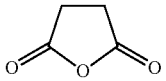

(a3) Monovalent Carboxylic Acid or Precursor of Monovalent Carboxylic Acid

The monovalent carboxylic acid a3 or the precursor of the monovalent carboxylic acid a3 (hereinafter, also referred to as an (a3) component) which is a component to be used in the condensation reaction for obtaining the condensate A will be described.

Examples of the monovalent carboxylic acid a3 or the precursor of the monovalent carboxylic acid a3 in the present invention include an aliphatic carboxylic acid, an aromatic carboxylic acid, and carboxylic acid precursor structures thereof, and the aliphatic carboxylic acid and a carboxylic acid precursor structure thereof are preferable. The number of carbon atoms of the monovalent carboxylic acid a3 or the precursor of the monovalent carboxylic acid a3 is preferably greater than or equal to 5, is more preferably greater than or equal to 8, and is particularly preferably greater than or equal to 9, from the viewpoint of lubrication properties in rigorous conditions such as a high temperature and/or a high pressure.

It is preferable that the monovalent carboxylic acid a3 or the precursor of the monovalent carboxylic acid a3 has a branch alkyl group from the viewpoint of lubrication properties in rigorous conditions such as a high temperature and/or a high pressure.

More preferred examples of the monovalent carboxylic acid a3 or the precursor of the monovalent carboxylic acid a3 include an aliphatic monovalent carboxylic acid or a precursor of the aliphatic monovalent carboxylic acid having greater than or equal to 9 carbon atoms and a branch alkyl group, or an aliphatic monovalent carboxylic acid or a precursor of the aliphatic monovalent carboxylic acid having greater than or equal to 13 carbon atoms and a straight chain alkyl group or a branch alkyl group.

Here, the precursor indicates a group which is able to form an ester bond by reacting with the alkylene oxide adduct a1 of the trihydric or more polyhydric alcohol or the alcohol of the monohydric alcohol a4, and carboxylic acid halide, carboxylic acid ester (preferably, methyl ester and ethyl ester), carboxylic anhydride, and mixed anhydride of a carboxylic acid and other acids (preferably, a sulfonic acid such as a methane sulfonic acid and a toluene sulfonic acid, and a substituent carboxylic acid such as a trifluoroacetic acid) are preferable as the precursor. Hereinafter, in the detailed description of the monovalent carboxylic acid a3, the precursor is also included.

Specific examples of a preferred monovalent carboxylic acid a3 include a monovalent carboxylic acid having a straight chain alkyl group, such as a butanoic acid, a pentanoic acid, a hexanoic acid, a heptanoic acid, an octanoic acid, a decanoic acid, a stearic acid, a dodecanoic acid, a lauric acid, a tetradecanoic acid, and a behenic acid, a monovalent carboxylic acid having a branch alkyl group, such as a 2,3,4,8,10,10-hexamethyl undecane-5-carboxylic acid, a 2-ethyl hexanoic acid, and a 2-heptyl undecanoic acid (an isostearic acid), and an unsaturated fatty acid such as an oleic acid, a linoleic acid, an erucic acid, and a monomer acid, and among them, the stearic acid, the 2-ethyl hexanoic acid, and the 2-heptyl undecanoic acid (the isostearic acid) are preferable, and the 2-heptyl undecanoic acid (the isostearic acid) is more preferable.

Hereinafter, specific examples of the monovalent carboxylic acid a3 or the precursor of the monovalent carboxylic acid a3 which is able to be used in the present invention will be described, but the present invention is not limited thereto.

a3-1

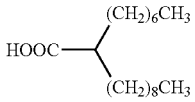

a3-2

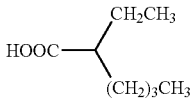

a3-3

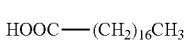

(a4) Monohydric Alcohol

The monohydric alcohol a4 (hereinafter, also referred to as an (a4) component) which is a component to be used in the condensation reaction for obtaining the condensate A will be described.

The monohydric alcohol a4 is a compound having one hydroxyl group in one molecule. The monohydric alcohol a4 is denoted by R—OH. R is a monovalent aliphatic group, a monovalent alicyclic group, or a monovalent aromatic ring group, and one or more carbon atoms which are not adjacent to each other in carbon atoms of R may be substituted with an oxygen atom. The number of carbon atoms of R is preferably greater than or equal to 4, is more preferably greater than or equal to 6, is particularly preferably greater than or equal to 8, and is even more preferably greater than or equal to 10. By setting the number of carbon atoms of the monohydric alcohol to be in the range described above, it is possible to improve solubility with respect to various base oils, to improve friction properties, and to suppress volatilization of the monohydric alcohol at the time of performing the condensation reaction.

It is more preferable that the monohydric alcohol a4 has a branch alkyl group from the viewpoint of lubrication properties in rigorous conditions such as a high temperature and/or a high pressure.

It is preferable that the monohydric alcohol a4 has an alkylene oxy structure from the viewpoint of lubrication properties in rigorous conditions such as a high temperature and/or a high pressure.

Monohydric alcohol having an alkyl group and/or a branch alkyl group in which the number of carbon atoms is greater than or equal to 10, and/or monohydric alcohol having an alkylene oxy structure are more preferable as the monohydric alcohol a4.

Examples of the monohydric alcohol a4 which is suitable for the present invention include butanol, isobutanol, pentanol, propanol, hexanol, 2-ethyl hexanol, heptanol, octanol, decanol, dodecanol, hexadecanol, octadecanol, 2-heptyl undecanol, eicosadecanol, phytosterol, isostearyl alcohol, stearol, cetol, behenol, an alkylene oxide adduct of the monohydric alcohol (a compound having an alkylene oxy structure), and the like.

It is preferable that the monohydric alcohol a4 which is used in the present invention has an alkylene oxy structure, and it is more preferable that the monohydric alcohol a4 is denoted by General Formula (3) described below.

General Formula (3)

$$R^a\text{-}(O(CX^{a1}X^{a2})_{na1})_{na2}\text{-}OH$$

Here, in General Formula (3), $R^a$ is an alkyl group which may have a substituent group, a cycloalkyl group which may have a substituent group, an alkenyl group which may have a substituent group, an aryl group which may have a substituent group, or a hetero aryl group which may have a substituent group, and $X^{a1}$ and $X^{a2}$ each independently represent a hydrogen atom, a halogen atom, or an alkyl group. In addition, na1 represents an integer of 2 to 4, and na2 represents an integer of 1 to 20.

The number of carbon atoms of an alkyl group portion in the alkyl group which is represented by $R^a$ and may have a substituent group is preferably 2 to 25, is more preferably 4 to 22, is even more preferably 6 to 20, and is particularly preferably 8 to 18. The alkyl group represented by $R^a$ may be a straight chain alkyl group or a branch alkyl group, and the branch alkyl group is preferable from the viewpoint of lubrication properties in rigorous conditions such as a high temperature and/or a high pressure and from the viewpoint of solubility at the time of being used as an additive with respect to base oil.

In addition, $R^a$ may be a cycloalkyl group which may have a substituent group.

The number of carbon atoms of an alkenyl group portion in the alkenyl group which is represented by $R^a$ and may have a substituent group is preferably 3 to 22, is more preferably 4 to 18, and is even more preferably 8 to 18. The alkenyl group represented by $R^a$ may be a straight chain alkenyl group, a branch alkenyl group, or a cyclic alkenyl group.

The number of carbon atoms in an aryl group portion of the aryl group or the hetero aryl group which is represented by $R^a$ and may have a substituent group is preferably 6 to 17, and is more preferably 6 to 12. Examples of the aryl group represented by $R^a$ are able to include a phenyl group, a naphthyl group, and the like, and among them, the phenyl group is particularly preferable. In addition, an imidazolyl group, a pyridyl group, a quinolyl group, a furyl group, a thienyl group, a benzoxazolyl group, an indolyl group, a benzimidazolyl group, a benzothiazolyl group, a carbazolyl group, and an azepinyl group are able to be exemplified as the hetero aryl group represented by $R^a$. An oxygen atom, a sulfur atom, and a nitrogen atom are preferable as a hetero atom included in the hetero aryl group, and among them, the oxygen atom is preferable.

Among them, in General Formula (3), it is more preferable that $R^a$ is the alkyl group which may have a substituent group.

Examples of the substituent group of $R^a$ include a substitutional or non-substitutional alkyl group having 1 to 50 carbon atoms (for example, methyl, ethyl, straight chain or branch chain propyl, straight chain or branch chain butyl, straight chain or branch chain pentyl, straight chain or branch chain hexyl, straight chain or branch chain heptyl, straight chain or branch chain octyl, straight chain or branch chain nonyl, straight chain or branch chain decyl, straight chain or branch chain undecyl, straight chain or branch chain dodecyl, straight chain or branch chain tridecyl, straight chain or branch chain tetradecyl, straight chain or branch chain pentadecyl, straight chain or branch chain hexadecyl, straight chain or branch chain heptadecyl, straight chain or branch chain octadecyl, straight chain or branch chain nonadecyl, straight chain or branch chain eicosyl, straight chain or branch chain heneicosyl, straight chain or branch chain docosyl, straight chain or branch chain tricosyl, or straight chain or branch chain tetracosyl); an alkenyl group having 2 to 35 carbon atom (for example, propenyl, butenyl, pentenyl, hexenyl, heptenyl, octenyl, nonenyl, decenyl, undecenyl, and dodecenyl); a cycloalkyl group having 3 to 10 carbon atom (for example, cyclopropyl, cyclobutyl, cyclopentyl, cyclohexyl, and cycloheptyl); an aromatic ring group having 6 to 30 carbon atom (for example, phenyl, naphthyl, biphenyl, phenanthryl, and anthracenyl), a heterocyclic group (preferably, a heterocyclic residue including at least one hetero atom selected from a nitrogen atom, an oxygen atom, and a sulfur atom, and for example, pyridyl, pyrimidyl, triazinyl, thienyl, furyl, pyrrolyl, pyrazolyl, imidazolyl, triazolyl, thiazolyl, oxazolyl, thiadiazolyl, oxadiazolyl, quinolyl, and isoquinolyl); or a group formed of a combination thereof. The substituent group may further have one or more substituent groups in a case where it is possible, and examples of the substituent group include an alkoxy group, an alkoxy carbonyl group, a halogen atom, an ether group, an alkyl carbonyl group, a cyano group, a thioether group, a sulfoxide group, a sulfonyl group, an amide group, and the like.

In addition, in General Formula (3), $X^{a1}$ and $X^{a2}$ each independently represent a hydrogen atom, a halogen atom, or an alkyl group, and $X^{a1}$ and $X^{a2}$ each independently are more preferably a hydrogen atom or an alkyl group. A preferred range of the alkyl group represented by $X^{a1}$ and $X^{a2}$ is identical to the preferred range of the alkyl group portion in the alkyl group which is represented by $R^a$ and may have a substituent group.

In General Formula (3), na1 represents an integer of 2 to 4, and na1 is more preferably an integer of 2 or 3, and is even more preferably 2.

In addition, na2 represents an integer of 1 to 20, and na2 is more preferably an integer of 1 to 15, is even more preferably an integer of 1 to 10, and is particularly preferably an integer of 1 to 7.

The number of carbon atoms of the monohydric alcohol denoted by General Formula (3) is preferably greater than or equal to 4, is more preferably greater than or equal to 6, is particularly preferably greater than or equal to 8, and is even more preferably greater than or equal to 10. By using such monohydric alcohol, it is possible to improve solubility with respect to various base oils, to improve friction properties, and to suppress volatilization of the monohydric alcohol at the time of performing the condensation reaction.

Hereinafter, specific example of the monohydric alcohol a4 which is able to be used in the present invention will be described, but the present invention is not limited thereto.

MA-1

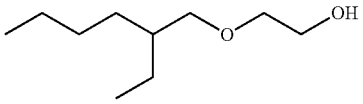

MA-2

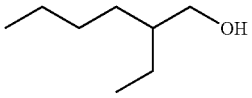

MA-3 $C_{18}H_{37}(OCH_2CH_2)_4OH$

MA-4

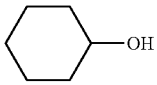

MA-5 $CH_3CH_2OH$

MA-6 $CH_3(CH_2)_2OH$

MA-7

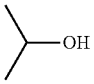

MA-8 $CH_3(CH_2)_3OH$

MA-9

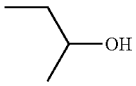

MA-10 $CH_3(CH_2)_9OH$

MA-11 $CH_3(CH_2)_{11}OH$

MA-12 $CH_3(CH_2)_{13}OH$

MA-13 $CH_3(CH_2)_{15}OH$

MA-14 $CH_3(CH_2)_{17}OH$

MA-15

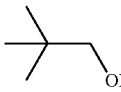

MA-16 $CH_3(OC_2H_4)_2OH$

MA-17 $C_2H_5(OC_2H_4)_3OH$

MA-18 $C_4H_9(OC_3H_5)_3OH$

MA-19 $CH_3(OC_2H_4)_8OH$

-continued

MA-20 $C_2H_5(OC_4H_8)_5OH$

MA-21

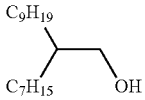

MA-22

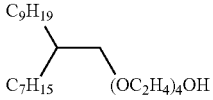

MA-23 $(CH_3)_3Si(OSi(CH_3)_2)_4(OC_2H_4)_4OH$

MA-24 $C_6F_{13}CH_2CH_2OH$

MA-25

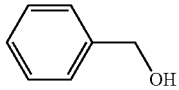

MA-26

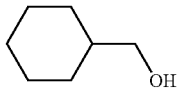

MA-27

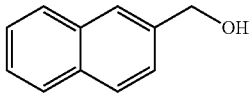

MA-28

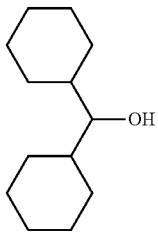

MA-29

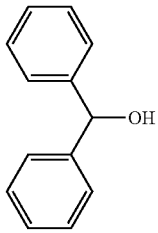

MA-30

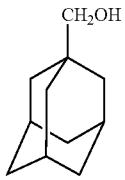

MA-31

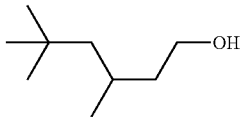

MA-32

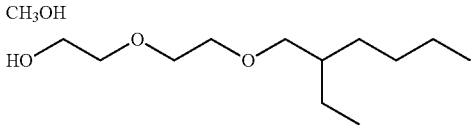

-continued

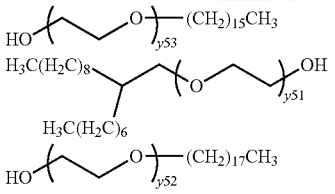

In the condensate A, components other than the (a1) component to the (a4) component may be further condensed. Examples of such a component include dihydric alcohol (preferably, aliphatic dihydric alcohol having 2 to 50 carbon atoms), and monovalent or other-valent amines which are able to form an amide bond by being condensed with a carboxylic acid.

The condensate A may be a pure substance formed of one type of compound, or may be a mixture of two or more types of compounds.

It is preferable that the condensate A is a pure substance or a mixture having a structure (a1-a2-a4) in which a structure derived from the alkylene oxide adduct a1 of the trihydric or more polyhydric alcohol is bonded to a structure derived from the monohydric alcohol a4 through a structure derived from the divalent or more polyvalent carboxylic acid a2 or the precursor derived from of the divalent or more polyvalent carboxylic acid a2, and/or a structure (a2-a1-a3) in which a structure derived from the divalent or more polyvalent carboxylic acid a2 or the precursor of the divalent or more polyvalent carboxylic acid a2 is bonded to a structure derived from the monovalent carboxylic acid a3 or the precursor of the monovalent carboxylic acid a3 through a structure derived from the alkylene oxide adduct a1 of the trihydric or more polyhydric alcohol. In the condensate A, it is preferable that a polymer structure (herein, the polymer structure has an oligomer structure) is formed in which the same type or different types of a plurality of structures having the structure (a1-a2-a4) described above and/or the structure (a2-a1-a3) described above are connected is formed. That is, it is preferable that the condensate A is a polymer.

The condensate having a polymer structure in which the same type or different types of a plurality of structures having the structure (a1-a2-a4) described above and/or the structure (a2-a1-a3) described above are connected may further have a structure (a1-a2-a1) in which two or more structures derived from the alkylene oxide adduct a1 of the trihydric or more polyhydric alcohol are bonded through the structure derived from the divalent or more polyvalent carboxylic acid a2 or the precursor derived from of the divalent or more polyvalent carboxylic acid a2 in a part of the polymer structure.

The condensate A having such a structure is able to be synthesized by the following manufacturing method or the like.

(Manufacturing Method and Identification Method of Condensate A)

The condensate A is able to be obtained by a condensation reaction of at least the alkylene oxide adduct a1 of the trihydric or more polyhydric alcohol which is formed by adding alkylene oxide to at least one hydroxyl group of the trihydric or more polyhydric alcohol, the divalent or more polyvalent carboxylic acid a2 or the precursor of the divalent or more polyvalent carboxylic acid a2, and at least one of the monovalent carboxylic acid a3, the precursor of the monovalent carboxylic acid a3, or the monohydric alcohol a4.

In a feed ratio at the time of performing the condensation reaction, at least the (a1) component to the (a4) component are condensed preferably at a molar ratio of a carboxyl group of the total carboxylic acid and the total alcohol/a hydroxyl group of 2/1 to 1/2, more preferably at a molar ratio of 1.5/1 to 1/1.5, and even more preferably at a molar ratio of 1/1 to 1/1.3, and is particularly preferably at a molar ratio of 1/1 to 1/1.2. In a case where alcohol is excessively used, it is possible to decrease the acid number of the condensate and to suppress a damage with respect to a member at the time of being used as a lubricant.

It is preferable that a ratio of the (a2) component/the (a3) component in the total carboxylic acid is 1/0 to 1/20 in the molar ratio of the carboxyl group. In case where the (a4) component is 0, the ratio of the (a2) component/the (a3) component is preferably 1.5/1 to 1/10, and is more preferably 1/1 to 1/5 in the molar ratio of the carboxyl group.

It is preferable that a ratio of the (a1) component/the (a4) component in the total alcohol is 1/0 to 1/20 in the molar ratio of the hydroxyl group. In a case where the (a3) component is 0, the ratio of the (a1) component/the (a4) component is preferably 1.5/1 to 1/10, and is more preferably 1.5/1 to 1/2 in the molar ratio of the hydroxyl group.

Here, the (a3) component and the (a4) component which are used for manufacturing the condensate A are not simultaneously set to 0.

The mixture fed as described above is subjected to a condensation reaction in the presence of a catalyst or a condensation agent or in the absence of a catalyst, and thus, the condensate A is able to be obtained.

When the condensation is performed, it is desirable that heating is performed or a solvent azeotropic with water or low molecular alcohol exists in a suitable amount. Accordingly, the reaction also progresses smoothly without coloring a product. The solvent is preferably a hydrocarbon-based solvent having a boiling point of 100° C. to 200° C., is more preferably a hydrocarbon-based solvent having a boiling point of 100° C. to 170° C., and is most preferably a hydrocarbon-based solvent having a boiling point of 110° C. to 160° C. Examples of the solvent include toluene, xylene, mesitylene, and the like. In a case where the amount of the solvent to be added excessively increases, a liquid temperature is in the vicinity of the temperature of the solvent, and the condensation rarely progresses. In contrast, in a case where the amount of the solvent to be added excessively decreases, azeotropy is not smoothly performed. Therefore, the added amount is preferably 1 mass % to 25 mass %, is more preferably 2 mass % to 20 mass %, is particularly preferably 3 mass % to 15 mass %, and is most preferably 5 mass % to 12 mass %, with respect to the total amount of a raw material.

The reaction is accelerated by using the catalyst, but a post treatment of removing the catalyst is complicated, and thus, it is desirable that the catalyst is not used since the catalyst causes coloration of a product. However, in a case where the catalyst is used, general conditions and operation are used in a general catalyst. This can be referred to references such as JP2001-501989A, JP2001-500549A, JP2001-507334A, and JP2002-509563A.

After the feeding ends, the reaction is performed at a liquid temperature of 120° C. to 250° C., preferably at a liquid temperature of 130° C. to 230° C., more preferably at a liquid temperature of 150° C. to 230° C., and particularly preferably at a liquid temperature of 170° C. to 230° C. Accordingly, a solvent containing water or low molecular alcohol is azeotropic, is cooled in a cooling portion, and becomes a liquid, and thus, is separated. The water may be removed. After the reaction is performed at a low temperature, and the reaction may be further performed at a high temperature.

In a reaction time, the amount of theoretically generated water is calculated by the number of moles of the feeding, and thus, it is preferable that the reaction is performed until a time point at which the amount of water is obtained, but it is difficult to completely end the reaction. Even in a case where the reaction ends at a time point at which the amount of theoretically generated water is 60% to 90%, lubrication properties of a lubricant composition containing the obtained condensate A are excellent. The reaction time is 1 hour to 24 hours, is preferably 3 hours to 18 hours, is more preferably 5 hours to 18 hours, and is most preferably 6 hours to 15 hours.

In the reaction mixture of condensation obtained as described above, condensates other than the condensate A obtained by a reaction of all of a1, a2, a3, and/or a4 (for example, a condensate obtained by a reaction of only a part of the configuration components, such as a condensate obtained by a reaction of only a1 and a2, a condensate obtained by a reaction of only a1 and a3, and a condensate obtained by a reaction of only a2 and a4) may also be contained.

It is preferable that the kinematic viscosity of the condensate A at 40° C. is 50 $mm^2/s$ to 2,000 $mm^2/s$. The kinematic viscosity of the condensate A at 40° C. is preferably greater than or equal to 50 $mm^2/s$, is more preferably greater than or equal to 70 $mm^2/s$, and is even more preferably greater than or equal to 100 $mm^2/s$. In addition, the kinematic viscosity of the condensate A at 40° C. is preferably less than or equal to 2,000 $mm^2/s$, is more preferably less than or equal to 1,500 $mm^2/s$, and is even more preferably less than or equal to 1,000 $mm^2/s$. By setting the kinematic viscosity of the condensate A to be in the range described above, it is possible to suppress the friction coefficient of the composition to be low, and thus, it is possible to increase lubrication properties. Herein, specifically, a value measured in a thermostatic water tank at 40.0° C. is adopted as the kinematic viscosity of the condensate A at 40° C. by using a UBBELOHDE viscosimeter.

The molecular weight of the condensate A is preferably 1,000 to 100,000, is more preferably 2,000 to 20,000, and is even more preferably 3,000 to 10,000 in the weight average molecular weight in terms of standard polystyrene using a gel permeation chromatography (GPC). By setting the molecular weight to be in a suitable range, it is possible to obtain excellent lubrication properties at a low viscosity. Herein, specifically, a value measured in the following conditions is adopted as the weight average molecular weight of the condensate A in terms of polystyrene.

A "HLC-8220GPC (manufactured by TOSOH CORPORATION) device", and three columns of "TSKgel, SuperHZM-H (manufactured by TOSOH CORPORATION, 4.6 mmID×15 cm)", "TSKgel, SuperHZ4000 (manufactured by TOSOH CORPORATION, 4.6 mmID×15 cm)", and "TSKgel, SuperHZ2000 (manufactured by TOSOH CORPORATION, 4.6 mmID×15 cm)" were used.

For example, the following conditions are able to be adopted as the conditions of GPC.

Eluant THF
Flow Rate 0.35 ml/min
Measurement Temperature 40° C. (Column, Inlet, RI)
Analysis Time 20 minutes
Sample Concentration 0.1%
Sample Injection Amount 10 μl In the present invention, unreacted COOH may remain in the condensate A, or OH may exist, but in a case where OH and COOH remain, the hydroxyl number and the acid number increase, and thus, may not be preferable according to the application. In such a case, OH and COOH disappear by a separate acylation treatment and/or an esterification treatment, and thus, it is possible to reduce the hydroxyl number and the acid number.

A ratio of the unreacted OH group of the condensate A is determined by measuring $^{13}C$-NMR. In the application of a lubricant, the remaining rate of the OH group of the condensate A is preferably 0% to 40%, is more preferably 0% to 35%, and is even more preferably 0% to 30%.

In addition, in the application of the lubricant, the acid number of the condensate A (the number of mg of KOH required for neutralizing 1 g of a sample) is preferably 0 mg KOH to 50 mg KOH, is more preferably 0 mg KOH to 30 mg KOH, and is even more preferably 0 mg KOH to 20 mg KOH. However, the acid number is not limited to the range. Herein, specifically, a value measured according to a JISK2501 method is used as the acid number of the condensate A (the number of mg of KOH required for neutralizing 1 g of a sample).

After the reaction and the treatment after the reaction end, it is preferable that filtration is performed to remove dust or the like. Furthermore, in a case where the product becomes a solid, the product is able to be taken out by being melted, or is able to be taken out as a powder by reprecipitation.

<Components Other than Condensate a of Lubricant Composition>

The present invention relates to a lubricant composition containing at least the condensate A. For example, in the lubricant composition of the present invention, the condensate A, a reaction mixture of condensation other than the condensate A, various additives and/or mediums are able to be added.

Here, the reaction mixture of condensation other than the condensate A indicates a component other than the condensate A among reaction mixtures of condensation which are obtained in a case of performing a condensation reaction of at least the alkylene oxide adduct a1 of the trihydric or more polyhydric alcohol formed by adding alkylene oxide to at least one hydroxyl group of the trihydric or more polyhydric alcohol, the divalent or more polyvalent carboxylic acid a2 or the precursor of the divalent or more polyvalent carboxylic acid a2, and at least one of the monovalent carboxylic acid a3, the precursor of the monovalent carboxylic acid a3, or the monohydric alcohol a4. Examples of the reaction mixture of condensation other than the condensate A are able to include a condensate other than the condensate A, and the like.

The amount of the condensate A is preferably 0.01 mass % to 100 mass %, is more preferably 0.01 mass % to 20 mass %, is particularly preferably 0.05 mass % to 5 mass %, and is more particularly preferably 0.1 mass % to 3 mass %, in the total lubricant composition. The condensate A exhibits excellent lubrication properties by being added to a medium in a small amount.

A particularly preferred embodiment of the lubricant composition of the present invention is a lubricant composition in which the ratio of the condensate A is 0.1 mass % to 20 mass %, the ratio of the medium is 70 mass % to 99.9 mass %, and the ratio of the condensate A and the component other than the medium is 0 mass % to 29.9 mass %, with respect to the total lubricant composition.

Furthermore, the entire reaction mixture of condensation may be used in the lubricant composition of the present invention without purifying the condensate A from the reaction mixture of condensation containing the condensate A and the condensate other than the condensate A. In this case, a preferred range of the ratio of the "reaction mixture of condensation" with respect to the lubricant composition of the present invention is identical to the preferred range of the ratio of the condensate A with respect to the lubricant composition of the present invention. That is, in this case, a preferred embodiment of the lubricant composition of the present invention is a lubricant composition in which the ratio of the reaction mixture of condensation is 0.1 mass % to 20 mass %, the ratio of the medium is 70 mass % to 99.9 mass %, and the ratio of the component other than the reaction mixture of condensation and the medium is 0 mass % to 29.9 mass %.

Furthermore, examples of the reaction mixture of condensation other than the condensate A are able to include a condensate other than the condensate A.

Examples of the component other than the medium, that is, examples of an additive are able to include one or two or more selected from an abrasion inhibiting agent, a viscosity index improving agent (preferably, polyalkyl (meth)acrylate, and a (meth)acrylate copolymer having an alkyl (meth) acrylate-polar group), an antioxidant (preferably, a phenol compound and an amine compound), a detergent (preferably, Ca sulfonate, Ca phenate, Mg sulfonate, Ca salicylate, (boric acid-modified) succinic acid imide, and succinic acid ester), a dispersing agent, a fluidizing aid, a curing agent, a corrosion inhibiting agent, a sealing compliance agent, an anti-foaming agent (preferably, polydimethyl silicone), a rust inhibiting agent, a friction adjusting agent, and a thickener.

By adding such an additive, it is possible to provide a preferred function such as abrasion suppression as a lubricant. The additive which is able to be used in the present invention can be referred to the description in paragraphs [0098] to [0165] of JP2011-89106A.

A preferred compound as the condensate A and the component other than the medium, that is, a preferred additive with respect to the lubricant composition of the present invention is a compound having at least one of zinc, molybdenum, sulfur, or phosphorus. Such a compound has a function of a friction adjusting agent, an abrasion inhibiting agent, an antioxidant, and the like. The compound containing at least one of zinc, molybdenum, sulfur, or phosphorus as a constituent element indicates a compound which may contain the zinc, the molybdenum, the sulfur, and the phosphorus in the compound in any state. Specifically, examples of the compound are able to include a compound containing zinc, molybdenum, sulfur, and phosphorus as a single body (the oxidation number of 0), an ion, a complex, and the like.

Examples of such a compound include an organic molybdenum compound, an inorganic molybdenum compound, an organic zinc compound, a phosphoric acid derivative, an organic sulfur compound, and the like. Among them, the organic molybdenum compound and the organic zinc compound are preferable.

In addition, only one type of the compound containing at least one of the zinc, the molybdenum, the sulfur, or the phosphorus as a constituent element may be added to the lubricant composition of the present invention, or two or more types of the compounds may be added to the lubricant composition of the present invention in combination. In a case where two or more types of the compounds containing at least one of the zinc, the molybdenum, the sulfur, or the phosphorus as a constituent element are added to the lubricant composition of the present invention in combination, it is preferable that two or more of the organic molybdenum compound, the inorganic molybdenum compound, the organic zinc compound, the phosphoric acid derivative, and the organic sulfur compound are combined, and it is more preferable that the organic molybdenum compound and the organic zinc compound are combined.

Hereinafter, a preferred embodiment of each of the organic molybdenum compound, the inorganic molybdenum compound, and the organic zinc compound will be described.

Examples of the organic molybdenum compound which is used in the lubricant composition as an additive are able to include an organic molybdenum compound containing phosphorus, such as molybdenum dithiophosphate (also referred to as MoDTP).

Examples of another organic molybdenum compound are able to include an organic molybdenum compound containing sulfur, such as molybdenum dithiocarbamate (also referred to as MoDTC). For example, oxy molybdenum-N, N-di-octyl dithiocarbamate sulfide ($C_8$—Mo(DTC)), oxy molybdenum-N,N-di-tridecyl dithiocarbamate sulfide ($C_{16}$—Mo(DTC)), and the like are preferable as organic molybdenum compound containing sulfur.

Examples of another organic molybdenum compound containing sulfur are able to include a complex with an inorganic molybdenum compound. Examples of the inorganic molybdenum compound to be used in the organic molybdenum compound which is a complex between an inorganic molybdenum compound and a sulfur-containing organic compound are able to include molybdenum oxide such as molybdenum dioxide and molybdenum trioxide, a molybdic acid such as an orthomolybdic acid, a paramolybdic acid, and (poly)molybdic sulfide, a molybdate such as a metal salt and an ammonium salt of the molybdic acids, molybdenum sulfide such as molybdenum disulfide, molybdenum trisulfide, molybdenum pentasulfide, and polymolybdenum sulfide, molybdic sulfide, a metal salt or an amine salt of the molybdic sulfide, molybdenum halide such as molybdenum chloride, and the like. In addition, examples of the sulfur-containing organic compound to be used in the organic molybdenum compound which is the complex between the inorganic molybdenum compound and the sulfur-containing organic compound are able to include alkyl (thio)xanthate, thiadiazole, mercaptothiadiazole, thiocarbonate, tetrahydrocarbyl thiuram disulfide, bis(di(thio) hydrocarbyl dithiophosphonate) disulfide, organic (poly) sulfide, ester sulfide, and the like.

Examples of another organic molybdenum compound containing sulfur are able to include a complex between a sulfur-containing molybdenum compound such as molybdenum sulfide and molybdic sulfide and alkenyl succinic acid imide.

An organic molybdenum compound which does not contain phosphorus or sulfur as a constituent element is able to be used as the organic molybdenum compound. Specifically, examples of the organic molybdenum compound which does not contain phosphorus or sulfur as a constituent element include a molybdenum-amine complex, a molybdenum-succinic acid imide complex, a molybdenum salt of an organic acid, a molybdenum salt of alcohol, and the like, and among them, the molybdenum-amine complex, the molybdenum salt of the organic acid, and the molybdenum salt of the alcohol are preferable.

Examples of the inorganic molybdenum compound which is used in the lubricant composition as an additive are identical to the examples of the inorganic molybdenum compound to be used in the organic molybdenum compound which is the complex between the inorganic molybdenum compound and the sulfur-containing organic compound.

Zinc dithiophosphate (ZDTP) denoted by General Formula (4) described below is preferable as the organic zinc compound which is used in the lubricant composition as an additive.

General Formula (4)

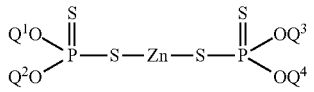

In General Formula (4), $Q^1$, $Q^2$, $Q^3$, and $Q^4$ may be identical to each other or different from each other, and each independently represent an alkyl group having 8 to 20 carbon atoms such as an isopropyl group, a butyl group, an isobutyl group, a pentyl group, an isopentyl group, a neopentyl group, a hexyl group, a heptyl group, an octyl group, a 2-ethyl hexyl group, a nonyl group, a decyl group, an undecyl group, a dodecyl group, a tridecyl group, an isotridecyl group, a myristyl group, a palmityl group, and a stearyl group.

Specifically, zinc n-butyl-n-pentyl dithiophosphoric acid ($C_4/C_5$ ZnDTP), zinc di-2-ethyl hexyl dithiophosphoric acid ($C_8$ ZnDTP), or zinc isopropyl-1-ethyl butyl dithiophosphoric acid ($C_3/C_6$ ZnDTP) is preferable as the zinc dithiophosphate denoted by General Formula (4).

In the lubricant composition of the present invention, in a case where the organic molybdenum compound is used, the content of the organic molybdenum compound is preferably 10 ppm to 1,000 ppm, is more preferably 50 ppm to 800 ppm, and is even more preferably 100 ppm to 600 ppm, with respect to the total mass of the lubricant composition.

In addition, in a case where the organic zinc compound is used, the content of the organic zinc compound is preferably 0.01 mass % to 5 mass %, is more preferably 0.01 mass % to 3 mass %, and is even more preferably 0.01 mass % to 1 mass %, with respect to the total mass of the lubricant composition.

By setting the content of the organic metal compound such as the organic molybdenum compound or the organic zinc compound in the lubricant composition of the present invention to be in the range described above, it is possible to increase the stability of the lubricant composition, to improve lubrication properties in rigorous conditions such as a high temperature and/or a high pressure, and to exhibit more excellent lubrication performance and abrasion suppression performance.

In addition, examples of the medium are able to include one or two or more selected from mineral oil, fatty oil compound, polyolefin oil (for example, poly alpha olefin), silicone oil, perfluoropolyether oil, ester oil (for example, aromatic ester oil, monovalent fatty acid ester, divalent fatty acid diester, and polyol ester lubricating oil), and a diphenyl ether derivative.

In the present invention, the "medium" indicates all mediums which are generally referred to as a "fluidic liquid". Here, it is not necessary that the medium is in a liquid phase at room temperature or at a temperature to be used, but a material in any state such as a solid and a gel other than the liquid is able to be used. The medium which is used in the present invention is not particularly limited, and is able to be selected from various liquids according to the application. The medium which is able to be used in the present invention can be referred to the description in paragraphs [0067] to [0096] of JP2011-89106A. The kinematic viscosity of the medium at 40° C. is preferably 1 $mm^2/s$ to 500 $mm^2/s$, is more preferably 1.5 $mm^2/s$ to 200 $mm^2/s$, and is even more preferably 2 $mm^2/s$ to 50 $mm^2/s$.

The viscosity index of the medium is preferably greater than or equal to 90, is more preferably greater than or equal to 105, and is even more preferably greater than or equal to 110. In addition, it is preferable that the viscosity index of the medium is less than or equal to 160. By setting the viscosity index to be in the range described above, viscosity-temperature properties, heat and oxidation stability, and volatilization inhibiting properties become excellent, and abrasion inhibiting properties are improved.

Furthermore, the viscosity index in the present invention indicates a viscosity index measured on the basis of JIS K 2283-1993.

<Properties of Lubricant Composition>

The kinematic viscosity of the lubricant composition of the present invention at 40° C. is preferably less than or equal to 2,000 $mm^2/s$, is more preferably less than or equal to 1,000 $mm^2/s$, is even more preferably less than or equal to 200 $mm^2/s$, and is particularly preferably less than or equal to 50 $mm^2/s$. A suitable viscosity is required according to the use environment, and thus, it is necessary that the viscosity is in the range described above. Herein, specifically, a value measured in a thermostatic water tank at 40.0° C. by using an UBBELOHDE viscosimeter is adopted as the kinematic viscosity of the lubricant composition at 40° C.

In the lubricant composition of the present invention, it is preferable that the constituent element is formed of only carbon, hydrogen, oxygen, and nitrogen, and it is more preferable that the constituent element is formed of only carbon, hydrogen, and oxygen. In addition, even in oil which is used as an oily medium, there are various materials configured of only carbon, hydrogen, and oxygen. By combining the elements, it is possible to prepare a lubricant composition in which a constituent element is formed of only carbon, hydrogen, oxygen, and nitrogen.

Furthermore, in general, current lubricating oil contains phosphorus, sulfur, and heavy metal. Lubricating oil to be used in a 2-stroke engine in which the lubricating oil combusts along with fuel does not contain phosphorus and heavy metal in consideration of an environmental load, but contains sulfur in the amount of approximately half of the amount of lubricating oil to be used in a 4-stroke engine. That is, in a current lubrication technology, it is assumed that the formation of a boundary lubrication film due to sulfur is essential even in a case where the amount of sulfur is minimized, and a load on a catalyst for purifying exhaust gas becomes extremely large by containing a sulfur element. Platinum or nickel is used as the catalyst for purifying the exhaust gas, but a poisoning action of phosphorus or sulfur becomes a significant problem. From such a viewpoint, it is extremely advantageous that the element configuring the composition of the lubricating oil is formed of only carbon, hydrogen, oxygen, and nitrogen. Further, the element formed of only carbon, hydrogen, and oxygen is most suitable for lubricating oil of an industrial machine, in particular, an apparatus associated with food production in addition to engine oil. In a current technology, an environmentally friendly element composition is obtained at the sacrifice of a friction coefficient. This is an extremely preferred technology in lubricating oil for metal cutting and working in which a large amount of water is required for cooling.

<Preparation Method of Lubricant Composition>

The lubricant composition of the present invention is able to be prepared by adding the condensate A into an oily medium or an aqueous medium, and by dissolving and/or dispersing the condensate A. The dissolution and/or the dispersion may be performed under heating.

<Application of Lubricant Composition>

The lubricant composition of the present invention is useful as a lubricant. That is, the present invention relates to a lubricant composition having the condensate A described above or the lubricant composition described above.

The lubricant composition of the present invention, for example, is able to be used for reduce friction by being supplied to a space between two sliding surfaces. The lubricant composition of the present invention is able to form a coating film on the sliding surface. Specifically, examples of the material of the sliding surface include carbon steel for a mechanical structure, alloy steel for a mechanical structure such as a nickel chromium steel material, a nickel chromium molybdenum steel material, a chromium steel material, a chromium molybdenum steel material, and an aluminum chromium molybdenum steel material, stainless steel, maraging steel, and the like, in steel.

Various metals other than steel, or inorganic materials or organic materials other than metal are also widely used as the material of the sliding surface. Examples of the inorganic material or the organic material other than metal include various plastics, ceramics, carbons, a mixed body thereof, and the like. More specifically, examples of the metal material other than steel include cast iron, a copper.copper-lead.aluminum alloy, casting thereof, and white metal.

Furthermore, the material of the sliding surface can be referred to the description in paragraphs [0168] to [0175] of JP2011-89106A.

The lubricant composition of the present invention is able to be used in various applications. For example, the lubricant composition of the present invention is able to be used as lubricating oil for grease, a releasing agent, engine oil for an internal combustion engine, oil for metal working (cutting), bearing oil, fuel for a combustion engine, vehicle engine oil, gear oil, operating oil for an automobile, lubricating oil for a vessel and an aircraft, machine oil, turbine oil, hydraulic operating oil, compressor and vacuum pump oil, freezer oil, a lubricating oil agent for metal working, a lubricant for a magnetic recording medium, a lubricant for a micro machine, a lubricant for an artificial bone, shock absorber oil, or rolling oil. Further, the lubricant composition of the present invention is also used in an air conditioner or a refrigerator including a reciprocating type or rotating type airtight compressor, an air conditioner or a dehumidifier for an automobile, a cooling device such as a freezer, a freezing refrigerating warehouse, a vending machine, a showcase, a chemical plant, and the like.

The lubricant composition of the present invention is useful as a lubricating oil agent for metal working which does not contain a chlorine-based compound, for example, when a metal material such as an iron and steel material or an Al alloy is subjected to hot rolling, or is subjected to working such as cutting, and is useful as metal working oil or metal plastic working oil such as cold rolling oil, cutting oil, grinding oil, drawing oil, and press working oil of aluminum, and in particular, is useful as an inhibitor against abrasion, damage, and surface roughness at the time of performing high-speed and high-load working, and is also useful as a metal working oil composition which is able to be applied to low-speed heavy cutting such as broach working and gun drill working.

In addition, the lubricant composition of the present invention is able to be used in various lubricating oils for grease, a lubricant for a magnetic recording medium, a lubricant for a micro machine, a lubricant for an artificial bone, and the like. In addition, it is possible to configure the element composition of the composition as a carbohydrate, and thus, for example, a composition in which sorbitan fatty acid ester containing polyoxy ethylene ether and edible oil are contained as base oil, which is widely used in cake mix, salad dressing, shortening oil, chocolate, and the like as an emulsifier, a dispersant, and a solubilizer, is used as lubricating oil, and therefore, high-performance lubricating oil which is entirely harmless to a human body is able to be used in the lubrication of a manufacturing device in a food manufacturing line or a medical instrument member.

Further, the lubricant composition of the present invention is dispersed by being emulsified in water system or is dispersed in a polar solvent or a resin medium, and thus, is able to be used as cutting oil or rolling oil.

In addition, the lubricant composition of the present invention is also able to be used as a releasing agent in various applications. For example, the lubricant composition of the present invention is used as a releasing agent of a polycarbonate resin, a flame retardant polycarbonate resin, a crystalline polyester resin which is a main component of a toner for forming an image used in an electrophotographic device, an electrostatic recording device, and the like, a thermoplastic resin composition for various moldings, an epoxy resin composition for sealing a semiconductor, and the like. One embodiment of the releasing agent is an embodiment in which the content of the condensate A is 0.01 parts by mass to 10 parts by mass (preferably, 0.1 parts by mass to 5 parts by mass) with respect to 100 parts by mass of a resin such as a polycarbonate resin.

In addition, the lubricant composition of the present invention is kneaded into or is applied onto a fiber product of a clothing material or the like in advance, and thus, is able to be used as a stain-proofing agent which accelerates removal of stain attached onto the fiber product and prevents the fiber product from being stained.

EXAMPLES

Hereinafter, the characteristics of the present invention will be more specifically described with reference to examples and comparative examples. Materials, used amounts, ratios, treatment contents, treatment sequences, and the like of the following examples are able to be suitably changed unless the changes cause deviance from the gist of the present invention. Accordingly, the range of the present invention will not be restrictively interpreted by the following specific examples.

Synthesis Example

(Synthesis Example 1) Synthesis of Condensate A1

Triethylene glycol monoethyl ether a4-4 (manufactured by Tokyo Chemical Industry Co., Ltd.), succinic anhydride a2-5 (manufactured by Wako Pure Chemical Industries, Ltd.), and toluene (7 mass % with respect to a raw material mixture) were fed into a reaction vessel attached with a DEAN-STARK dehydration device at a molar ratio shown in Table 1 described below. The mixture was heated at a liquid temperature of 120° C., and was stirred for 4 hours. An ethylene oxide adduct a1-3 of pentaerythritol (manufactured by Sigma-Aldrich Co. LLC., an average molecular weight of 797) was added thereto, and was stirred at a liquid temperature of 170° C. to 190° C. for 12 hours under nitrogen stream of 0.3 L/min. The toluene was recirculated while being stirred, and thus, water was removed. A reaction system was decompressed, and a volatile content was removed. The liquid temperature was set to room temperature, and filtration was performed. A condensate A1 was obtained as colorless and transparent oil.

(Synthesis Example 2) Synthesis of Condensate A2

An ethylene oxide adduct a1-1 of trimethylol propane (manufactured by Sigma-Aldrich Co. LLC., an average molecular weight of 450), a dimer a2-1 of an unsaturated fatty acid having 22 carbon atoms (manufactured by Croda International Plc, PRIPOL1004), and diethylene glycol mono-2-ethyl hexyl ether a4-1 (manufactured by Wako Pure Chemical Industries, Ltd.) were fed into a reaction vessel attached with a DEAN-STARK dehydration device at a molar ratio of 1.17/3/3.5. A reaction was performed at 190° C. for 5 hours under nitrogen stream of 0.3 L/min, and was further performed at 220° C. for 4 hours. Water generated during the reaction was removed. Cooling was performed to room temperature, and thus, a condensate A2 was obtained as a yellow transparent liquid material. In a reaction mixture of condensation at the time of synthesizing the condensate A2, the content of a polymer component including the condensate A2 was approximately 65%, the content of diester obtained by a reaction between the dimer a2-1 of the unsaturated fatty acid having 22 carbon atoms and two molecules of the diethylene glycol mono-2-ethyl hexyl ether a4-1 was approximately 30%, and the content of the unreacted diethylene glycol mono-2-ethyl hexyl ether was approximately 5%.

(Synthesis Example 3) Synthesis of Compound for Comparison X1

A compound for comparison X1 was obtained by the same method as that in Synthesis Example 1 except that pentaerythritol x2 was used instead of the ethylene oxide adduct a1-3 of the pentaerythritol. The compound for comparison X1 is a compound disclosed in Example 1 of JP2011-89106A.

(Synthesis Example 4) Synthesis of Compound for Comparison X2

A compound for comparison X2 was synthesized by the same method as that in Synthesis Example 2 except that trimethylol propane was used instead of the ethylene oxide adduct of the trimethylol propane. In the compound for comparison X2, the content of the unreacted diethylene glycol mono-2-ethyl hexyl ether was approximately 5%.

(Other Condensate A)

In other condensates A, the other condensates A were synthesized by the same method as that in Synthesis Example 2 except that a1 to a4 shown in Table 1 described below were mixed such that the molar ratios thereof were changed as shown in Table 1.

By using such a synthesis method, each of the condensates A becomes a pure substance or a mixture having a structure in which a structure derived from the alkylene oxide adduct a1 of the trihydric or more polyhydric alcohol is bonded to a structure derived from the monohydric alcohol a4 through a structure derived from the divalent or more polyvalent carboxylic acid a2 or the precursor of the divalent or more polyvalent carboxylic acid a2, and/or a structure in which a structure derived from the divalent or more polyvalent carboxylic acid a2 or the precursor of the divalent or more polyvalent carboxylic acid a2 is bonded to a structure derived from the monovalent carboxylic acid a3 or the precursor of the monovalent carboxylic acid a3 through a structure derived from the alkylene oxide adduct a1 of the trihydric or more polyhydric alcohol.

The weight average molecular weight Mw of each of the condensates A in terms of polystyrene was 3,000 to 10,000, and the acid number was less than or equal to 20 mgKOH/g.

In addition, the materials used in the synthesis of each of the condensates A will be described below.

Alkylene Oxide Adduct a1 of Trihydric or more Polyhydric Alcohol Used in Present Invention;

a1-1

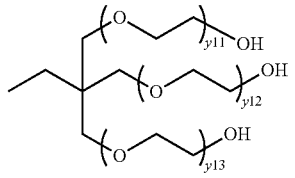

a1-2

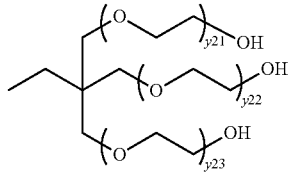

a1-3

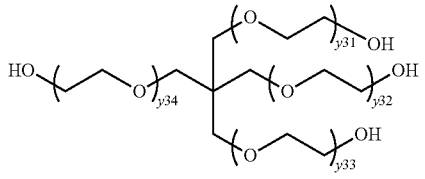

a1-4

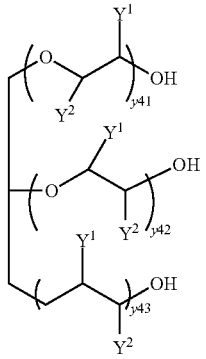

a1-1 is a compound having average Mn of 450 and y11+y12+y13 of 7 on average.

a1-2 is a compound having average Mn of 1,014 and y21+y22+y23 of 20 on average.

a1-3 is a compound having average Mn of 797 and y31+y32+y33+y34 of 15 on average.

a1-4 is a compound having average Mn of 725 and y31+y32+y33+y34 of 11 on average in which either $Y^1$ or $Y^2$ is a methyl group.

Alkylene Oxide Adduct of Polyhydric Alcohol or Dihydric Alcohol Compound for Comparison;

x1

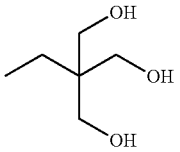

x2

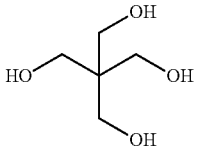

x3

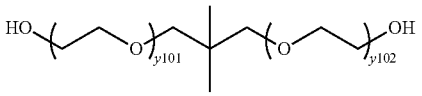

x3 is a compound having average Mn of 450 and y101+y102 of 8 on average.

Divalent or more Polyvalent Carboxylic Acid a2 or Precursor of Divalent or more Polyvalent Carboxylic Acid a2;

a2-1 is a dimer of an unsaturated carboxylic acid having 22 carbon atoms (PRIPOL1004, manufactured by Croda International Plc).

a2-2 is a dimer acid (a dimer of an unsaturated carboxylic acid having 18 carbon atoms) (TSUNODYME 395, manufactured by TSUNO CO., LTD.).

a2-3

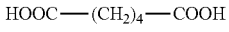

a2-4

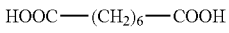

a2-5

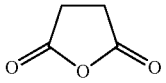

Monovalent Carboxylic Acid a3 or Precursor of Monovalent Carboxylic Acid a3;

a3-1

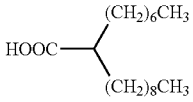

-continued a3-2

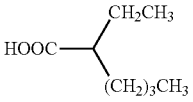

a3-3

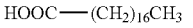

Monohydric Alcohol a4;

a4-1

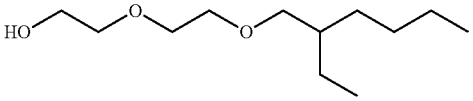

a4-2

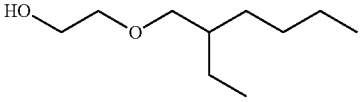

a4-3

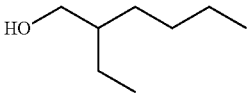

a4-4

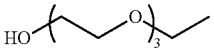

a4-5

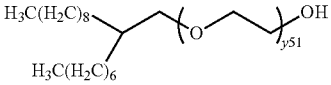

a4-6

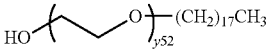

a4-7 a4-8

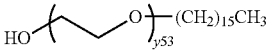

a4-5 is a compound having y51 of 5 on average.

a4-6 is a compound having y52 of 5 on average.

a4-8 is a compound having y53 of 5 on average.

TABLE 1

| | Trihydric or more Polyhydric Alcohol (a1 or others) | | (a2) | | (a3) | | (a4) | |
|---|---|---|---|---|---|---|---|---|
| | Structure | Molar Ratio | Structure | Molar Ratio | Structure | Molar Ratio | Structure | Molar Ratio |
| A1 | a1-3 | 1 | a2-5 | 4 | | | a4-4 | 5 |
| A2 | a1-1 | 1.17 | a2-1 | 3 | | | a4-1 | 3.5 |
| A3 | a1-1 | 1.17 | a2-1 | 3 | | | a4-3 | 3.5 |
| A4 | a1-2 | 1.17 | a2-2 | 3 | | | a4-5 | 3.5 |
| A5 | a1-1 | 1.17 | a2-2 | 3 | | | a4-2 | 3.5 |
| A6 | a1-2 | 1.17 | a2-2 | 3 | | | a4-6 | 3.5 |
| A7 | a1-3 | 1 | a2-2 | 4 | | | a4-5 | 5 |
| A8 | a1-2 | 1.17 | a2-2 | 3 | | | a4-7 | 3.5 |
| A9 | a1-2 | 1.17 | a2-2 | 3 | | | a4-8 | 3.5 |

TABLE 1-continued

| | Trihydric or more Polyhydric Alcohol (a1 or others) | | (a2) | | (a3) | | (a4) | |
|---|---|---|---|---|---|---|---|---|
| | Structure | Molar Ratio | Structure | Molar Ratio | Structure | Molar Ratio | Structure | Molar Ratio |
| A10 | a1-4 | 1 | a2-4 | 3 | | | a4-4 | 4 |
| A11 | a1-2 | 1 | a2-5 | 0.1 | a3-2 | 2.6 | | |
| A12 | a1-2 | 1 | a2-2 | 0.25 | a3-2 | 2.5 | | |
| A13 | a1-2 | 1 | a2-3 | 0.2 | a3-3 | 2.4 | | |
| A14 | a1-3 | 1 | a2-2 | 0.25 | a3-1 | 3.4 | | |
| A15 | a1-1 | 1 | a2-2 | 0.1 | a3-1 | 2.8 | | |
| A16 | a1-2 | 1 | a2-2 | 2.6 | a3-1 | 0.8 | a4-1 | 4 |
| X1 | x2 | 1 | a2-5 | 4 | | | a4-4 | 5 |
| X2 | x1 | 1.17 | a2-1 | 3 | | | a4-1 | 3.5 |
| X3 | x3 | 1.76 | a2-1 | 3 | | | a4-1 | 3.5 |
| X4 | x1 | 1 | a2-2 | 0.25 | a3-2 | 2.5 | | |
| X5 | a1-2 | 1 | | | a3-2 | 4 | | |

Examples c101 to c122 and Comparative Examples d101 to d108

The condensate A satisfying the regulations of the present invention, the compound for comparison, and the following medium were mixed at a ratio as shown in Table 2 described below, 2.0 mass % of calcium sulfonate was further added thereto as a metal-based detergent and was efficiently stirred at 80° C., and thus, a lubricant composition was prepared.

B1: Mineral Oil (SUPER OIL N46, manufactured by JX Nippon Oil & Energy Corporation)

B2: PAO Oil (ANDEROL FGC 32, manufactured by Anderol Inc.)

B3: Ester Oil (ANDEROL 495, manufactured by Anderol Inc.)

The obtained lubricant composition was set to lubricant compositions of Examples c101 to c122 and Comparative Examples d101 to d108.

Furthermore, it was confirmed that the kinematic viscosity of the lubricant composition of the present invention at 40° C. was 100 $mm^2/s$ to 1,000, $mm^2/s$ in Examples c101 and c111, and Comparative Examples d104 and d108 where the medium was not used, and the kinematic viscosity of the lubricant composition of the present invention at 40° C. was 30 $mm^2/s$ to 50 $mm^2/s$ in other examples and comparative examples where the medium was used, by using the method disclosed herein.

[Evaluation]

Test Example: Evaluation as Lubricating Oil for Internal Combustion Engine

<Friction Coefficient Evaluation>

The friction coefficient of lubricant composition of each of the examples and the comparative examples was measured by using a vibration type friction abrasion tester (manufactured by Optimol Instruments Prueftechnik GmbH, Product Name: SRV 3) in conditions of the number of vibrations of 50 Hz, the amplitude of vibration of 1.0 mm, a load and a temperature shown in Table 2 described below, and a test time of 30 minutes. An SUJ-2 ball of 10 mm was used as an upper test piece, and an SUJ-2 disk of 24 mm was used as a lower test piece. The observed friction coefficient was evaluated on the basis of the following criteria. The results are shown in Table 2 described below.

The conditions become rigorous as the load increases, and the temperature increases.

It is indicated that the lubrication properties become excellent as the friction coefficient decreases. Evaluation of A, B, C, or D is practically obtained.

A: Friction Coefficient<0.12

B: 0.12≤Friction Coefficient<0.15

C: 0.15≤Friction Coefficient<0.18

D: 0.18≤Friction Coefficient<0.20

E: Friction Coefficient≥0.20

<Abrasion Mark Diameter Evaluation>

In addition, the diameter of the abrasion mark of the SUJ-2 ball of 10 mm used as a test piece after performing a friction abrasion test at 200 N/120° C. was standardized by setting the abrasion mark diameter of Comparative Example d101 as 100%, and was evaluated on the basis of the following criteria. The results are shown in Table 2 described below.

It is indicated that the abrasion decreases as the value of the diameter decreases. A decrease in the abrasion mark was observed in evaluation of a to c. It was determined that a decrease in the abrasion mark of less than or equal to that of Comparative Example d101 was observed in evaluation of d. Evaluation of a or b is practically obtained.

a: Less than 50% b: Greater than or equal to 50% and less than 70% c: Greater than or equal to 70% and less than 95% d: Greater than or equal to 95%

TABLE 2

| | Composition | | Friction Coefficient (Load/Temperature) | | | Abrasion Mark Diameter |
|---|---|---|---|---|---|---|
| | Condensate A Structure (Mass Ratio) | Medium (Mass Ratio) | 100 N/ 80° C. | 200 N/ 80° C. | 200 N/ 120° C. | 200 N/ 120° C. |
| Example c101 | A1(100) | None | A | B | C | b |
| Example c102 | A2(1) | B1(99) | A | B | B | a |
| Example c103 | A3(1) | B1(99) | A | B | D | b |
| Example c104 | A4(1) | B1(99) | A | B | C | a |
| Example c105 | A5(1) | B1(99) | A | B | C | a |

TABLE 2-continued

| | Composition | | Friction Coefficient (Load/Temperature) | | | Abrasion Mark Diameter |
|---|---|---|---|---|---|---|
| | Condensate A Structure (Mass Ratio) | Medium (Mass Ratio) | 100 N/ 80° C. | 200 N/ 80° C. | 200 N/ 120° C. | 200 N/ 120° C. |
| Example c106 | A6(1) | B1(99) | A | B | C | a |
| Example c107 | A7(1) | B1(99) | A | B | C | a |
| Example c108 | A8(1) | B1(99) | A | B | D | b |
| Example c109 | A9(1) | B1(99) | A | B | C | b |
| Example c110 | A10(1) | B1(99) | A | B | D | b |
| Example c111 | A11(100) | None | A | B | D | b |
| Example c112 | A12(1) | B1(99) | A | B | D | b |
| Example c113 | A13(5) | B1(95) | A | B | D | b |
| Example c114 | A14(3) | B1(97) | A | B | D | b |
| Example c115 | A15(1) | B1(99) | A | B | D | b |
| Example c116 | A16(1) | B1(99) | A | B | C | a |
| Example c118 | A2(0.5) | B2(99) | A | B | B | a |
| Example c119 | A4(0.1) | B2(99) | A | B | C | a |
| Example c120 | A9(1) | B3(99) | A | B | C | a |
| Example c121 | A2(3) | B3(97) | A | B | B | a |
| Example c122 | A9(5) | B3(95) | A | B | C | a |
| Comparative Example d101 | None | B1 | C | D | E | d |
| Comparative Example d102 | None | B2 | C | D | E | c |
| Comparative Example d103 | None | B3 | C | D | E | c |
| Comparative Example d104 | X1(100) | None | B | C | D | c |
| Comparative Example d105 | X2(1) | B1(99) | B | C | D | c |
| Comparative Example d106 | X3(1) | B1(99) | B | C | D | c |
| Comparative Example d107 | X4(1) | B1(99) | B | C | D | c |
| Comparative Example d108 | X5(100) | None | B | C | E | c |

From Table 2 described above, it was found that the lubricant composition of the present invention had excellent lubrication properties in rigorous conditions such as a high temperature and/or a high pressure.

In contrast, from Comparative Examples d101 to d103, it was found that the lubricant composition in which the condensate A was not added and only base oil was used as a medium had deteriorated lubrication properties in rigorous conditions.

From Comparative Examples d104, d105, and d107, it was found that a lubricant composition using a condensate which was not in the range of the present invention from the viewpoint of not adding alkylene oxide and in which trihydric or more polyhydric alcohol x1 or x2 was used as a condensation material had deteriorated lubrication properties in rigorous conditions.

From Comparative Example d106, it was found that a lubricant composition using a condensate using x3 obtained by adding alkylene oxide to dihydric polyhydric alcohol of which the valence is less than the lower limit of the valence of the polyhydric alcohol of the present invention as a condensation material had deteriorated lubrication properties in rigorous conditions.

From Comparative Example d108, a lubricant composition using a condensate which is not in the range of the present invention from the viewpoint of not containing the divalent or more polyvalent carboxylic acid a2 or the precursor of the divalent or more polyvalent carboxylic acid a2 as a condensation material had deteriorated lubrication properties in rigorous conditions.

Examples c201 and c202, and Comparative Example d201

Lubricant compositions of Examples c201 and c202, and Comparative Example d201 were prepared such that the composition was changed as shown in Table 3 described below.

Furthermore, it was confirmed that the kinematic viscosity of all of the lubricant compositions of the present invention at 40° C. was 30 $mm^2/s$ to 50 $mm^2/s$, by using the method disclosed herein.

The friction coefficient and the abrasion mark diameter of the obtained lubricant composition of each of the examples and the comparative examples were observed by a method. The results are shown in Table 3 described below.

From Table 3 described below, it was found that the lubricant composition of the present invention was able to further reduce abrasion and had excellent lubrication properties in rigorous conditions by further adding a compound having at least one of zinc, molybdenum, sulfur, or phosphorus as a constituent element.

In contrast, from Comparative Example d201, it was found that a lubricant composition using only a compound having a medium and at least one of zinc, molybdenum, sulfur, or phosphorus as a constituent element without adding the condensate A had deteriorated lubrication properties in rigorous conditions.

TABLE 3

| | Composition | | | Friction Coefficient | | | Abrasion Mark Diameter |
|---|---|---|---|---|---|---|---|
| | Condensate A | Medium | | | | | |
| Test Number | Structure (Mass Ratio) | (Mass Ratio) | Other Components | 100 N/ 80° C. | 200 N/ 80° C. | 200 N/ 120° C. | 200 N/ 120° C. |
| Example c201 | A2(1) | B1(99) | MoDTC(0.05) ZnDTP(0.05) | A | A | B | a |
| Example c202 | A9(1) | B1(99) | MoDTC(0.05) ZnDTP(0.05) | A | B | B | a |
| Comparative Example d201 | None | B1 | MoDTC(0.05) ZnDTP(0.05) | B | C | D | c |

In Table 3, MoDTC indicates oxy molybdenum-N,N-dioctyl dithiocarbamate sulfide, and ZnDTP indicates zinc isopropyl-1-ethyl butyl dithiophosphate.

What is claimed is:

1. A lubricant composition containing a condensate A which is obtained by condensing at least:

an alkylene oxide adduct a1 of trihydric or more polyhydric alcohol formed by adding alkylene oxide to at least one hydroxyl group of the trihydric or more polyhydric alcohol;

a divalent or more polyvalent carboxylic acid a2 or a precursor of the divalent or more polyvalent carboxylic acid a2; and a monohydric alcohol a4, wherein the number of carbon atoms of the divalent or more polyvalent carboxylic acid a2 or the precursor of the divalent or more polyvalent carboxylic acid a2 is less than or equal to 44.

2. The lubricant composition according to claim 1, wherein the alkylene oxide adduct a1 of the trihydric or more polyhydric alcohol is formed by adding alkylene oxide to at least one hydroxyl group of at least one selected from trimethylol propane, trimethylol ethane, ditrimethylol propane, glycerol, pentaerythritol, and dipentaerythritol.

3. The lubricant composition according to claim 1, wherein the alkylene oxide adduct a1 of the trihydric or more polyhydric alcohol includes six or more alkylene oxy repeating units in the molecules on average.

4. The lubricant composition according to claim 1, wherein the alkylene oxide adduct a1 of the trihydric or more polyhydric alcohol is formed by adding alkylene oxides each independently to all hydroxyl groups of the trihydric or more polyhydric alcohol.

5. The lubricant composition according to claim 1, wherein the monohydric alcohol a4 has a branch alkyl group.

6. The lubricant composition according to claim 1, wherein the monohydric alcohol a4 has an alkylene oxy structure.

7. The lubricant composition according to claim 1, wherein the number of carbon atoms of the divalent or more polyvalent carboxylic acid a2 or the precursor of the divalent or more polyvalent carboxylic acid a2 is greater than or equal to 36.

8. The lubricant composition according to claim 1, wherein the condensate A is a pure substance or a mixture having a structure (a1-a2-a4) in which a structure derived from the alkylene oxide adduct a1 of the trihydric or more polyhydric alcohol is bonded to a structure derived from the monohydric alcohol a4 through a structure derived from the divalent or more polyvalent carboxylic acid a2 or the precursor of the divalent or more polyvalent carboxylic acid a2.

9. The lubricant composition according to claim 1, wherein the condensate A is a polymer.

10. The lubricant composition according to claim 1, wherein the condensate A is contained in the amount of 0.01 mass % to 20 mass % with respect to the total lubricant composition.

11. The lubricant composition according to claim 1, wherein a ratio of the condensate A is 0.1 mass % to 20 mass %, and a ratio of a medium is 70 mass % to 99.9 mass %, and a ratio of a component other than the condensate A and the medium is 0 mass % to 29.9 mass %, with respect to the total lubricant composition.

12. The lubricant composition according to claim 11, wherein the medium is at least one selected from mineral oil, polyolefin oil, ester oil, and ether oil.

13. The lubricant composition according to claim 11, wherein the component other than the condensate A and the medium is a compound having at least one of zinc, molybdenum, sulfur, or phosphorus as a constituent element.

* * * * *